US006732946B2

(12) United States Patent
Veazie

(10) Patent No.: US 6,732,946 B2
(45) Date of Patent: May 11, 2004

(54) APPARATUS AND METHOD FOR LOCATING AND REPAIRING A DAMAGED LAWN SPRINKLER HEAD

(76) Inventor: Waldemar Veazie, 905 SW. Lighthouse Dr., Palm City, FL (US) 34990

( * ) Notice: Subject to any disclaimer, the term of this patent is extended or adjusted under 35 U.S.C. 154(b) by 168 days.

(21) Appl. No.: 09/911,901

(22) Filed: Jul. 24, 2001

(65) Prior Publication Data

US 2003/0019950 A1 Jan. 30, 2003

(51) Int. Cl.[7] ..... B67D 5/08

(52) U.S. Cl. ..... 239/71; 239/200; 239/205; 239/569

(58) Field of Search ..... 239/71, 73, 200, 239/201, 204, 205, 569, 570; 116/281, 283, 277; 137/68.11, 553, 556

(56) References Cited

U.S. PATENT DOCUMENTS 5,524,824 A * 6/1996 Frimmer ..... 239/71

6,178,982 B1 * 1/2001 Longstreth ..... 137/68.14

* cited by examiner

*Primary Examiner*—Lisa A. Douglas
(74) *Attorney, Agent, or Firm*—Law Offices of Royal W. Craig

(57) ABSTRACT

A lawn irrigation sprinkler head that internally incorporates an alert and retrieval device which indicates the position of the head if damaged, and facilitates in-situ repair of the damaged head. The sprinkler head has a hollow body containing a pop-up riser connected to a nozzle. The alert and retrieval device is positioned between the base of the riser and the nozzle. Should the nozzle become damaged or dislodged, the alert device telescopically extends from the riser and signals the location of the damaged sprinkler head. The device facilitates the repair of the head by lifting the riser from within the sprinkler head so that a replacement nozzle can be attached. In an alternative embodiment the alert device has an integral shut-off valve which prevents the discharge of water in the event that a subsequent irrigation cycle occurs before the damaged head is repaired. The alert and retrieval device is suitable for retrofit application in existing pop-up style in-ground sprinkler heads, or may be incorporated in the process of the head's original manufacture.

18 Claims, 11 Drawing Sheets

APPARATUS AND METHOD FOR LOCATING AND REPAIRING A DAMAGED LAWN SPRINKLER HEAD

BACKGROUND OF THE INVENTION

1. Field of the Invention

The present invention relates to irrigation sprinkler heads and, more particularly, to a pop-up style sprinkler head having an integral device for indicating the position and facilitating the repair of the sprinkler head if it is damaged.

2. Description of the Background

Underground lawn irrigation systems commonly comprise a network of buried pipes connected at regular intervals to sprinkler heads. The RAINBIRD™ SP40 series pop-up spray head manufactured by Rain Bird Mfg. Corp., 145 N. Grand Ave., Glenboro, Calif., 91741 is an exemplary pop-up style sprinkler head representative of the prior art.

FIG. 1 illustrates a pop-up style sprinkler head connected to an underground irrigation system. The sprinkler head 102 extends upwardly from an elbow or "T" joint 104, and only the uppermost portion of head 102 is exposed beyond the surface of the ground. Sprinkler head 102 typically comprises a cylindrical housing 107 containing an internal pop-up riser 112 capped by a nozzle 108. Nozzle 108 emits a spray when actuated by water pressure, and the spray pattern is fixed as determined by the type of nozzle 108 attached to riser 112.

At the end of an irrigation cycle, the water pressure shuts off, and an internal spring mechanism retracts the riser 112 back into housing 107 of the sprinkler head. The retracted nozzle lies flush at ground level and is protected from damage by lawn mowers, power trimmers, foot traffic or other ground level hazards which could dislodge the nozzle 108 from riser 112. It is not uncommon for grass or foliage to overgrow the sprinkler head thereby obscuring it from view in the retracted position.

During the course of normal use it is also not uncommon for grit or debris to fall into the sprinkler head 102. An accumulation of this foreign matter prevents the riser from fully retracting, leaving riser 112 extended from housing 107, and exposing nozzle 108 above the surface of the ground. A pass with a lawn mower can easily dislodge the exposed nozzle 108 from riser 112, thereby damaging the sprinkler head 102. The damaged riser thereafter will not be affected by the application or removal of water pressure.

Alternatively, nozzle 108 may simply become dislodged due to pedestrian traffic or unscrewed from riser 112 rendering sprinkler head 102 defective. Damaged or defective sprinkler heads are difficult to locate, either because they become entirely submerged in large pools of water, or because grass obscures the location of sprinkler head 102 when the riser is in the complete or partially retracted position.

If nozzle 108 is dislodged from sprinkler head 102, an uncontrolled geyser gushes from the sprinkler head during subsequent irrigation cycles. This has several adverse consequences. First, it results in flooding of one area of the lawn, which damages turf and promotes disease. Second, under-watering of adjacent areas of the lawn usually occurs as a result of decreased water pressure to the downstream sprinkler heads. Also, the geyser unnecessarily wastes water during the irrigation cycle, and depending on the location and time of day, geysers may go undetected for extended periods of time.

Replacing the defective sprinkler head with an entirely new sprinkler head remedies the geyser problem. However, even after the geyser is observed locating the damaged sprinkler head once the sprinkler shuts-off is difficult because of the flooding or natural overgrowth problems discussed above. Moreover, once the defective sprinkler head is found, making the a repair entails digging-up the damaged sprinkler head. This requires undue expense and effort and damages the lawn in the area of the repair.

Alternatively, the defective sprinkler head can be repaired by replacing the missing nozzle. However, this simple remedy is complicated by the fact that, in its retracted position, the riser 112 is not easily accessible inside the narrow body of sprinkler head 102. The force from a retracting spring (not shown) must be overcome to lift riser 112 from housing 107, and the narrow cylinder of sprinkler head 102 does not easily permit one to grasp riser 112. Without a device to withdraw the retracted riser 112, the threads on the riser remain inaccessible, and a new nozzle cannot be attached without disassembling the complete sprinkler head which in turn usually requires excavating around the unit.

Few devices in the prior art have addressed the problem of signaling the position of a damaged sprinkler head. U.S. Pat. No. 5,524,824 to Frimmer teaches a shut-off valve for use in a sprinkler head. The shut-off valve is positioned in the riser of the sprinkler head. A short perforated tube extends from the valve, and is spring biased against the underside of the sprinkler head nozzle. If the nozzle is dislodged, the shut-off valve is immediately forced upwardly where it engages a valve seat and prevents the flow of water from the head. The tube extending through the top of the sprinkler head also immediately signals that the sprinkler head is damaged.

Unfortunately, the Frimmer '824 signaling device is a short fixed tube which becomes susceptible to damage from the same causal sources (rotary mowers, foot traffic or other ground hazards) because it deploys an instant after the nozzle is dislodged. It is highly likely in the case of the lawn mower inflicted damage that the mower would immediately truncate the signaling device negating its intended purpose. Therefore, it would be advantageous to have a sprinkler head with an integral apparatus for indicating the location of the damaged or defective sprinkler head (and facilitating its repair) that would deploy only when the nozzle is dislodged and water pressure is applied.

SUMMARY OF THE INVENTION

It is, therefore, an object of the present invention to provide a lawn irrigation sprinkler head incorporating a signaling device to indicate the position of the lawn sprinkler head if/when damaged.

It is another object of the present invention to enable the signaling device to facilitate the repair of the damaged head by providing a means to extract the riser from the inside of the damaged sprinkler head in order to replace a missing nozzle.

It is still further an object of the present invention to provide an integral shut-off valve on the alert and retrieval device to prevent the uncontrolled flow of water from a damaged sprinkler head during an irrigation cycle.

According to the present invention, the above-described and other objects are accomplished by providing a pop-up style lawn sprinkler head comprising an internal signaling and riser retrieval apparatus. The sprinkler head comprises a hollow, generally cylindrical housing threaded on the lower end for attachment to an elbow or "T" fitting on an irrigation pipe. The housing comprises an internal central channel occupied by a riser. A nozzle seals the top of the sprinkler head assembly when the riser is fully retracted in the housing.

The signaling and retrieval mechanism is a brightly colored, multi-stage telescoping element which resides in the central cavity of the riser. Under normal operating conditions, the device accompanies the riser as it is forced upwardly from the sprinkler head body by water pressure during a normal irrigation cycle. Water flows through the riser around the device and out the nozzle. In an undamaged sprinkler head, the upward telescoping movement of the device is limited by the nozzle. However, if the nozzle is dislodged, the water pressure causes the telescoping elements of the device to extend upwardly. When the irrigation cycle is complete, the self-latching device remains visible projecting from the top of the damaged sprinkler head.

Projecting from the sprinkler head, the brightly colored device signals the location of the damaged head, and is used to facilitate the replacement of the missing nozzle. Pulling upwardly on the device lifts the riser from the sprinkler head housing. This exposes the threads on the top of the riser, and enables a repair to be made by simply (1) holding the riser with one hand and pushing the telescoping device down within the riser and (2) screwing a replacement nozzle onto the riser. The riser retrieval feature of the signaling apparatus simplifies the repair process, and eliminates the labor intensive and aesthetically unpleasing task of digging up the entire sprinkler head.

In an alternative embodiment, the signaling and retrieval mechanism is a multi-stage telescoping element whose base, near the bottom of the riser also acts as a shut off valve. The base, which is spoked to allow the free flow of water when in the "down" position, is spring biased to the "up" position. The shut off valve is prevented from closing during normal irrigation cycles by the top of the telescoping device which is held down by the nozzle (and filter basket). Again, during normal operation, the device rides up and down with the riser and due to its flow-through characteristics does not affect normal sprinkling.

In a scenario that is all too familiar, the riser, following an irrigation cycle, fails to retract into the sprinkler (due to grit or debris). Subsequent to this a lawn mower (logically being used when the irrigation system is not operating) passes over the riser and in so doing dislodges the nozzle. Due to being hit, the riser may or may not retract within the sprinkler head.

Immediately, the spring loaded shut off valve moves up within the riser to a valve seat located within the riser. The telescoping device does not extend because water pressure is not present. By not extending at this time the telescoping device does not expose itself to the same causal factors that precipitated the removal of the nozzle. During the next irrigation cycle, water pressure is applied and due to the position of the shut off valve no geyser appears and no water is wasted. However, the water pressure acts on the telescoping device extending it to its self latching position. At the end of the cycle the brightly colored telescoping device remains in the "up" position facilitating observation by concerned individuals. The retrieval/repair function of the telescoping device may then be used as described in the first embodiment.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENTS

Figure 1:
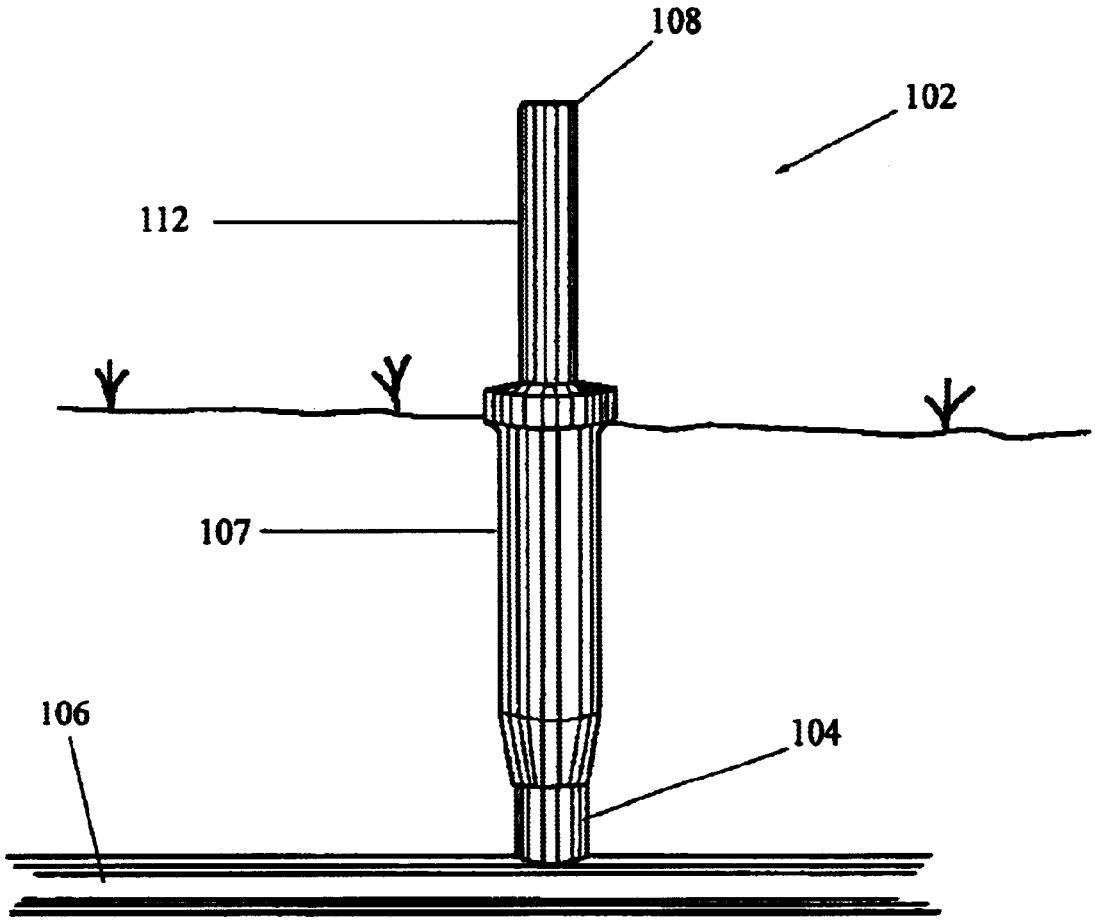
FIG. 1 (Prior Art)
FIG. 1 is an environmental view of a prior art sprinkler head installed on an underground irrigation pipe.
Figure 2:
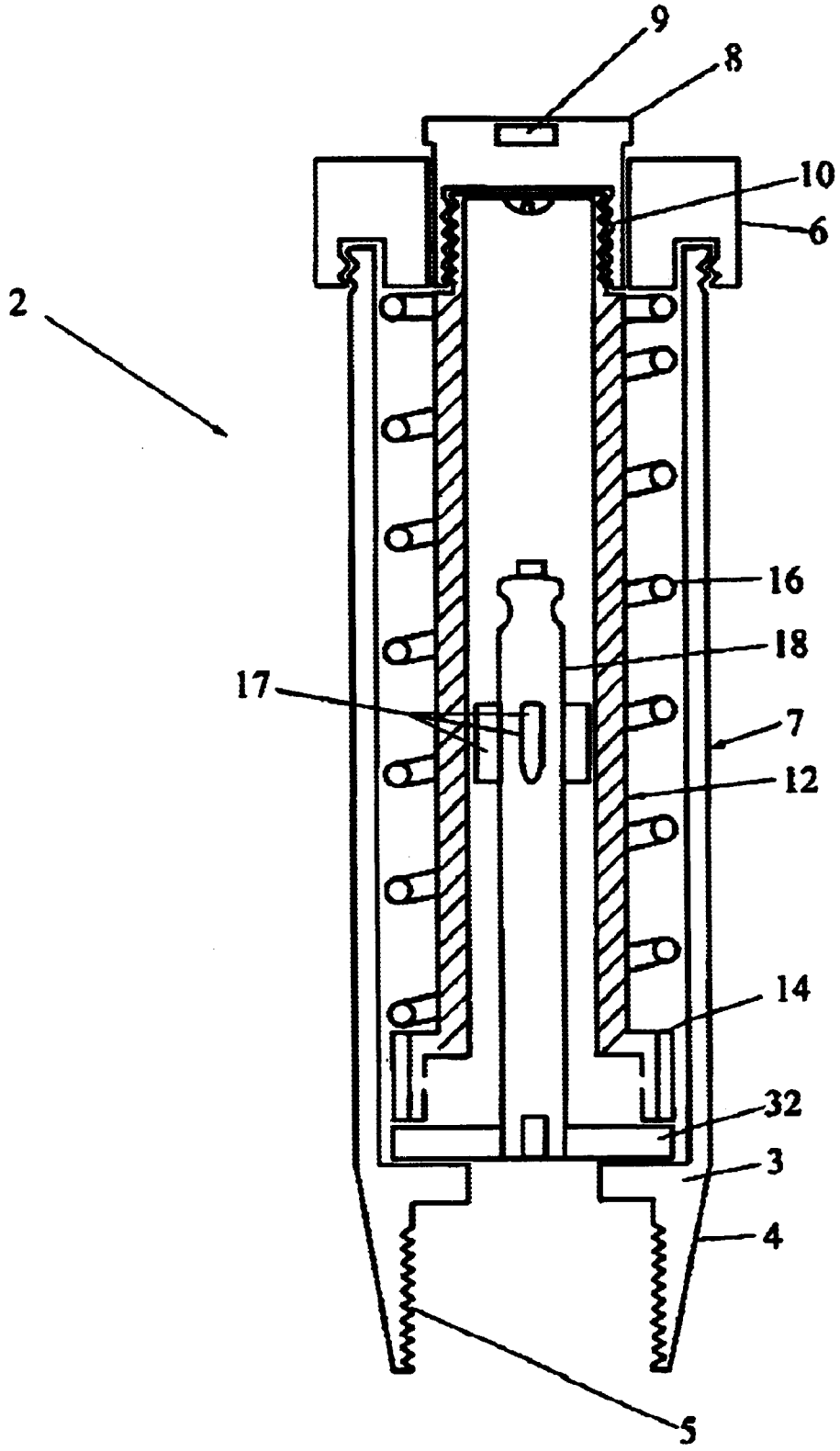
FIG. 2 is a schematic side view of the sprinkler head of the present invention in an undamaged resting state.

FIG. 2 shows a preferred embodiment of the improved lawn irrigation sprinkler head 2 of the present invention. The sprinkler head comprises an outer cylindrical housing 7 having distal base 4 and opposing cap 6. Base 4 preferably comprises inner threads 5 which engage the corresponding threads of an elbow or "T" fitting (104, FIG. 1) extending from an underground irrigation pipe (106, FIG. 1). Cap 6 is screwed to the top of sprinkler housing 7 and defines a constricted top closure. Cap 6 has a central aperture through which a nozzle 8 extends. Nozzle 8 is a short cylindrical element with opposing top and bottom ends. The top end is defined by a series of open slots or perforations 9 which allow water to flow from the sprinkler head. The number and arrangement of slots varies according to the spray pattern and coverage desired.

The bottom end of nozzle 8 is open, and comprises internal threads 10 which engage the corresponding threads on the top end of a riser 12. Riser 12 is a hollow tube positioned inside housing 7. An annular ridge 14 is formed at the lower end of riser 12. A conventional compression spring 16 is positioned inside of housing 7 and is inserted onto riser 12 such that the top end of the spring lies against the underside of cap 6, and the bottom end of the spring lies against top face of ridge 14. The downward bias from spring 16 maintains the riser 12 in a retracted position within the sprinkler head housing 7. Within the central hollow of riser 12 is a telescoping alert retriever (hereinafter TAR) 18.

Figure 5:
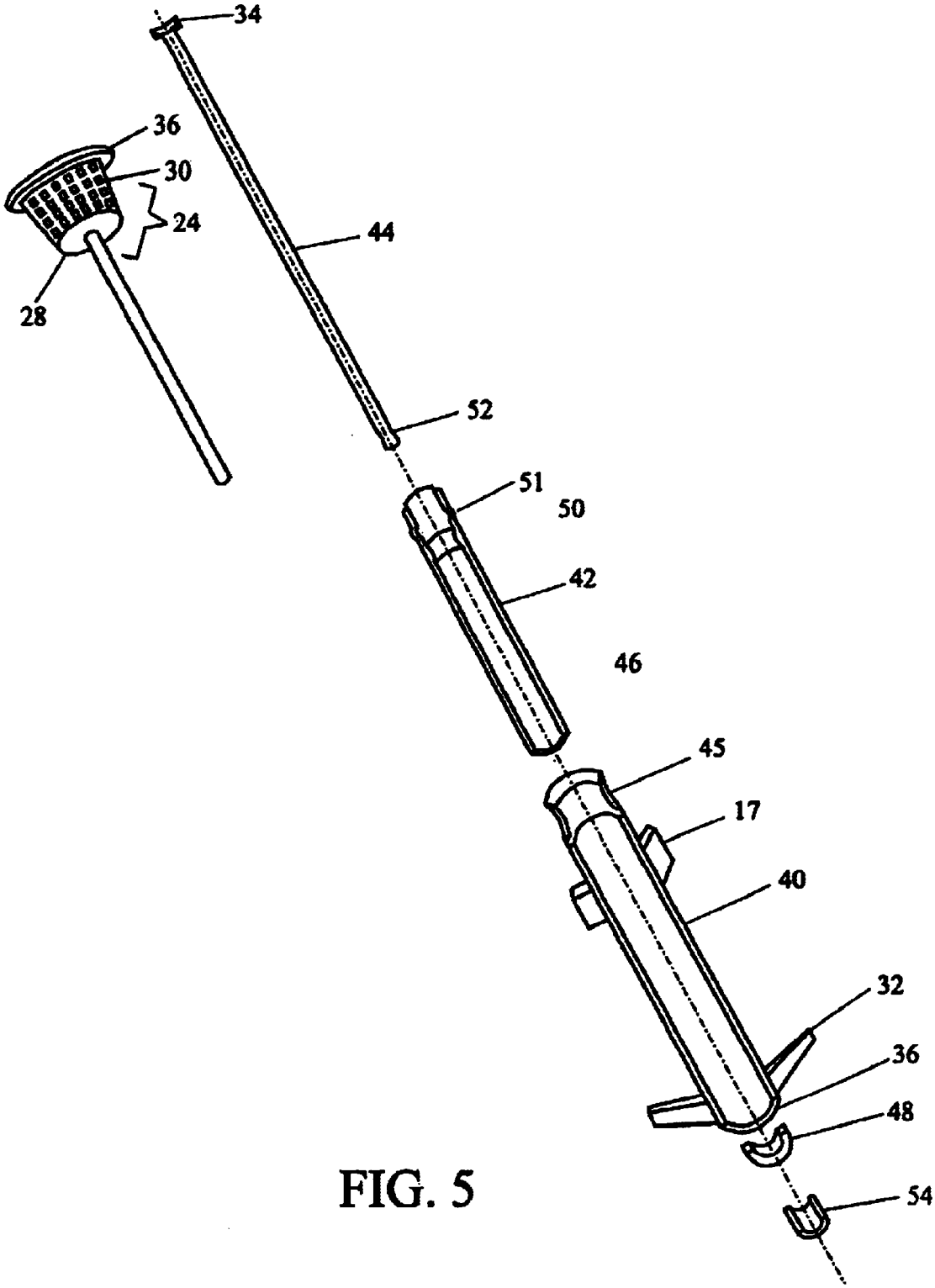
FIG. 5 is an exploded sectional view of the signaling and retrieval device of the present invention.

TAR 18, shown in FIG. 5, comprises a multi-stage telescoping device having opposing tip 34 and base 36. A grit filter 24 is optionally attached or rests at tip 34 to collect debris and foreign matter which otherwise would enter the nozzle through the water system or the aperture in cap 6. Grit filter 24 comprises a tapered, round side-wall 26 coupled to a circular base 28 which bear a plurality of holes 30. Holes 30 permit the irrigation water to flow upwardly, but prevent debris and foreign material from passing.

The telescoping sleeves of TAR 18 comprise first stage 40, second stage 42, and third stage 44. First stage 40 is a generally cylindrical hollow tube having opposing top and bottom ends, each end comprising an orifice which permits water to flow through. The bottom end comprises base 36 as described below. The top end slidingly engages second stage 42. The inner wall of first stage 40 is indented in the area immediately below its top end, and thereby forms a plurality of internal tabs 45. Tabs 45 hold the bottom end of second stage 42 at piston 48 when it is fully extended. The openings at the top of first stage 40 and second stage 42 are smaller than the respective inside diameters of the stages to prevent over-extension of stages 42 and 44 respectively. A plurality of alignment tabs 17 extend outwardly from approximately the midpoint of first stage 40, and maintain the alignment of TAR 18 in the central channel of riser 12.

Second stage 42 is likewise a generally cylindrical hollow tube having opposing top and bottom ends, the bottom end comprising an orifice which permits water to flow through. The outer wall of second stage 42 bears a circumferential groove 46 at its bottom end. Groove 46 functions as a piston retaining groove for second stage piston 48. Second stage piston 48 is an annular element which circumferentially engages second stage 42 and lodges against tabs 45 when second stage 42 is fully extended. The inner wall of second stage 42 is indented in the area immediately below its top end, forming a plurality of second stage tabs 50. Second stage tabs 50 hold the bottom end of third stage 44 when it is fully extended. An external circular ridge at the top of second stage 42 prevents the second stage from dropping out of the first stage 40.

Third stage 44 is a solid rod-like element having opposing top and bottom ends. The top end of third stage 44 comprises tip 34, which is adjacent to optional grit filter 24. The outer wall of third stage 44 bears a circumferential groove 52 at its bottom end. Third stage groove 52 functions as a piston retaining groove for third stage piston 54. Third stage piston 54 is an annular element which engages third stage 44 and lodges against second stage tabs 50 when third stage 44 is fully extended. Tip 34 or alternatively the base of grit filter 24 prevents third stage 44 from dropping out of the second stage 42.

Base 36 comprises a plurality of outwardly directed prongs 32 for engaging sprinkler housing 7. Referring back to FIG. 2, in an operative configuration within sprinkler housing 7, prongs 32 are sandwiched between ridge 14 on their top surface and shelf 3 of sprinkler body 2 on their bottom surface. Shelf 3 is an annular element extending from the inner wall of housing 7 near base 4.

Figure 3:
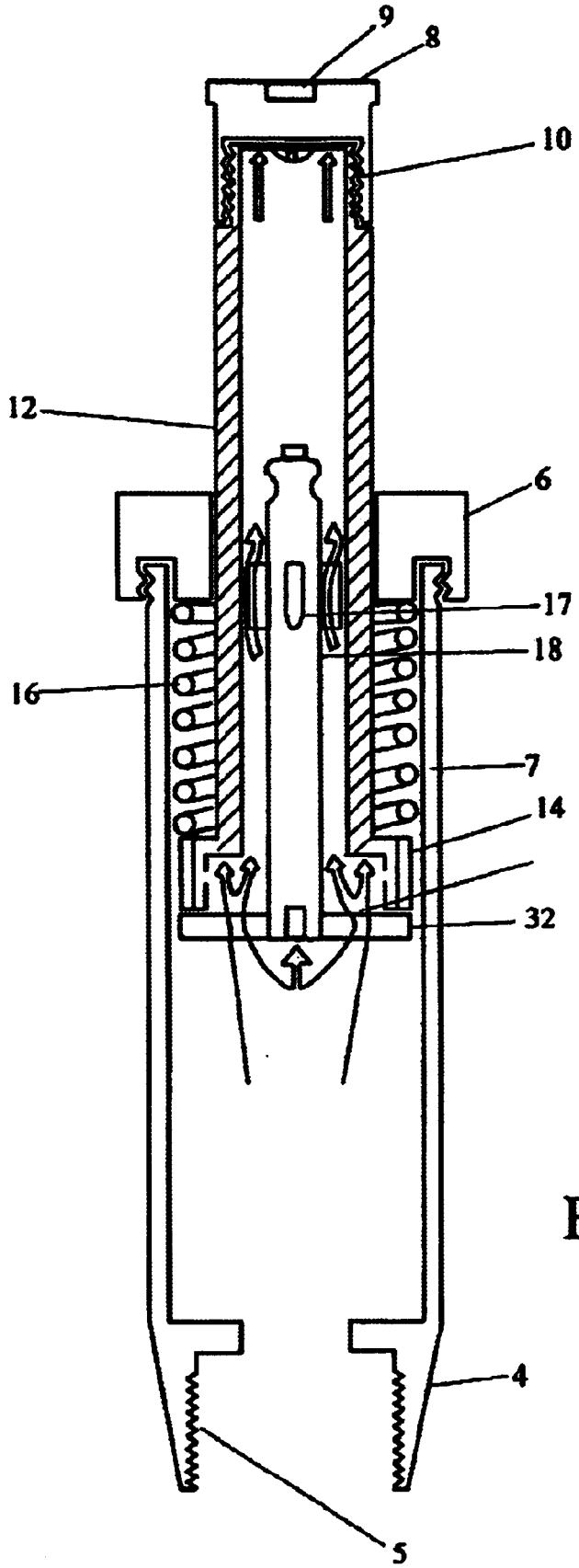
FIG. 3 is a schematic side view of the sprinkler head of the present invention in an undamaged condition during a normal irrigation cycle.

FIG. 3 shows the sprinkler head of the present invention during a normal irrigation cycle. Pressurized water 20 enters sprinkler head 2 through base 4, and flows into the channel of riser 12. The pressurized water flows past TAR 18 and strikes the underside of nozzle 8. The water pressure overcomes the downward force of spring 16 on riser 12, and thrusts nozzle 8 and riser 12 upwardly out of sprinkler head 2 through the aperture in cap 6. Ridge 14 secures the lower end of riser 12 within sprinkler head 2 and prevents the riser from being ejected in response to the surge of water pressure. Under normal operating conditions, water is thereby emitted from the nozzle and the lawn is irrigated.

Figure 4:
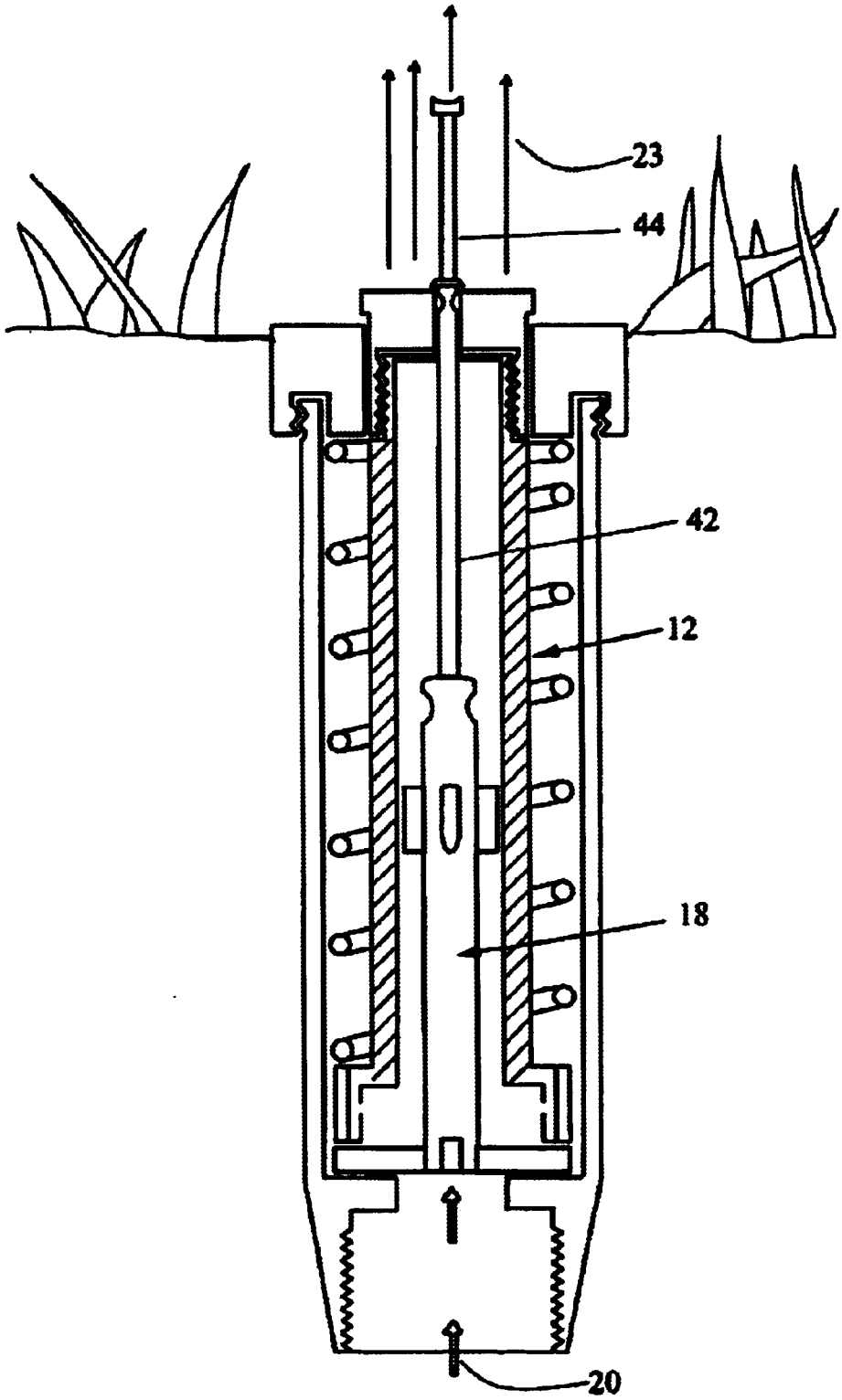
FIG. 4 is a schematic side view of the sprinkler head of the present invention during a normal irrigation cycle in which the nozzle is missing.

As shown in FIG. 3, the presence of nozzle 8 is critical to the proper operation of the sprinkler head 2. By contrast, FIG. 4 shows damaged sprinkler head 22 of the present invention where nozzle 8 is dislodged. After pressurized water 20 flows through riser 12 and around TAR 18, it bursts through the aperture in cap 6. Unimpeded by a nozzle, the pressurized water creates a geyser 23 from the damaged sprinkler head 22. Without the nozzle 8 in place the riser 12 remains inside the sprinkler head.

Water pressure 20 entering damaged sprinkler head 22 also enters the hollow body of TAR 18, and exerts force on pistons 48 and 54 and the bottom of stage three 44 (not visible in FIG. 4), causing the stages to telescope upwardly out of housing 7. Water pressure 20 causes full extension of TAR 18, and first stage tabs 45 and second stage tabs 50 (not visible in FIG. 4) engage pistons 48 and 54 respectively locking TAR 18 in its fully extended position where it remains after water pressure 20 shuts off. TAR 18 is thus visible above the surface of the ground, and above any pool of accumulated water, thereby signaling the location of the damaged sprinkler head until it is discovered. Subsequent irrigation cycles do not cause TAR 18 to retract.

Figure 6:
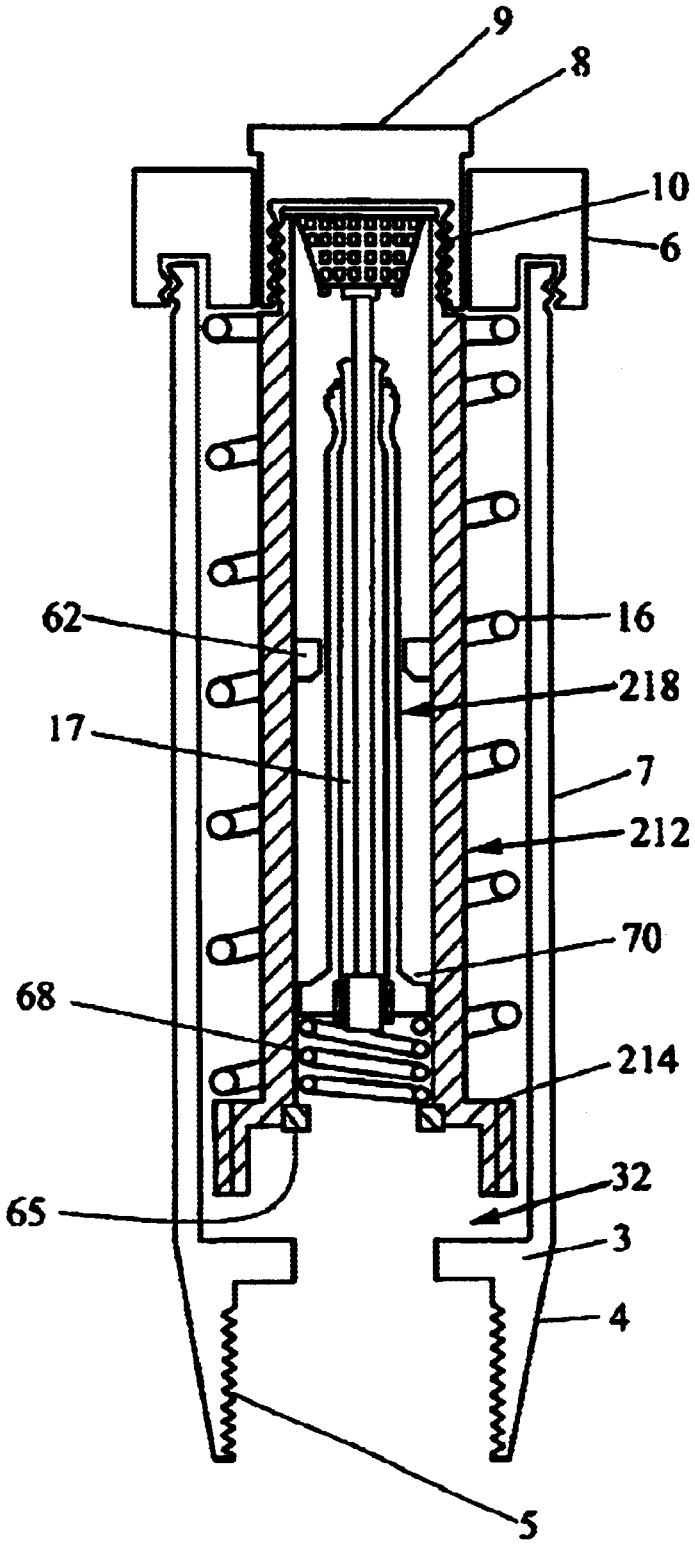
FIG. 6 is a schematic side view of an alternative embodiment of the sprinkler head of the present invention in which the signaling and retrieval device comprises an integral shut-off valve.

FIGS. 6 to 11 show an alternative embodiment of the present invention in which a modified TAR 218 additionally includes an integral shut-off valve. As shown in FIG. 6, riser 212 is modified to accommodate the modified TAR 218. Necessary modifications to modified riser 212 are shown in FIG. 6, and include the addition of a valve seat 62, a shut-off valve spring 68, and a retention groove 64 (visible in FIG. 11).

Valve seat 62 comprises an annular ridge on the inside wall of modified riser 212 approximately at its midpoint. The annular ridge forms an aperture of a sufficient diameter to allow passage of water and all three stages of modified TAR 218.

Retention groove 64 (visible in the sectional view of FIG. 11) comprises an annular recess having a plurality of notches on the inner wall of modified riser 212 opposite the top margin of ridge 214 on the outer wall. A snap ring 65 comprises radial extensions 67 which engage the notches in retention groove 64, and provides a seat for shut-off valve spring 68. Shut off valve spring 68 is a coil spring having a top end which lies against shut-off valve 70 (fully described below) and a bottom end which lies against snap ring 65. Spring 68 exerts an upward force on modified TAR 218. In the normal operative state, the lower face of nozzle 8 provides a downward force which compresses spring 68, and prevents shut-off valve 70 from engaging valve seat 62.

Figure 11:
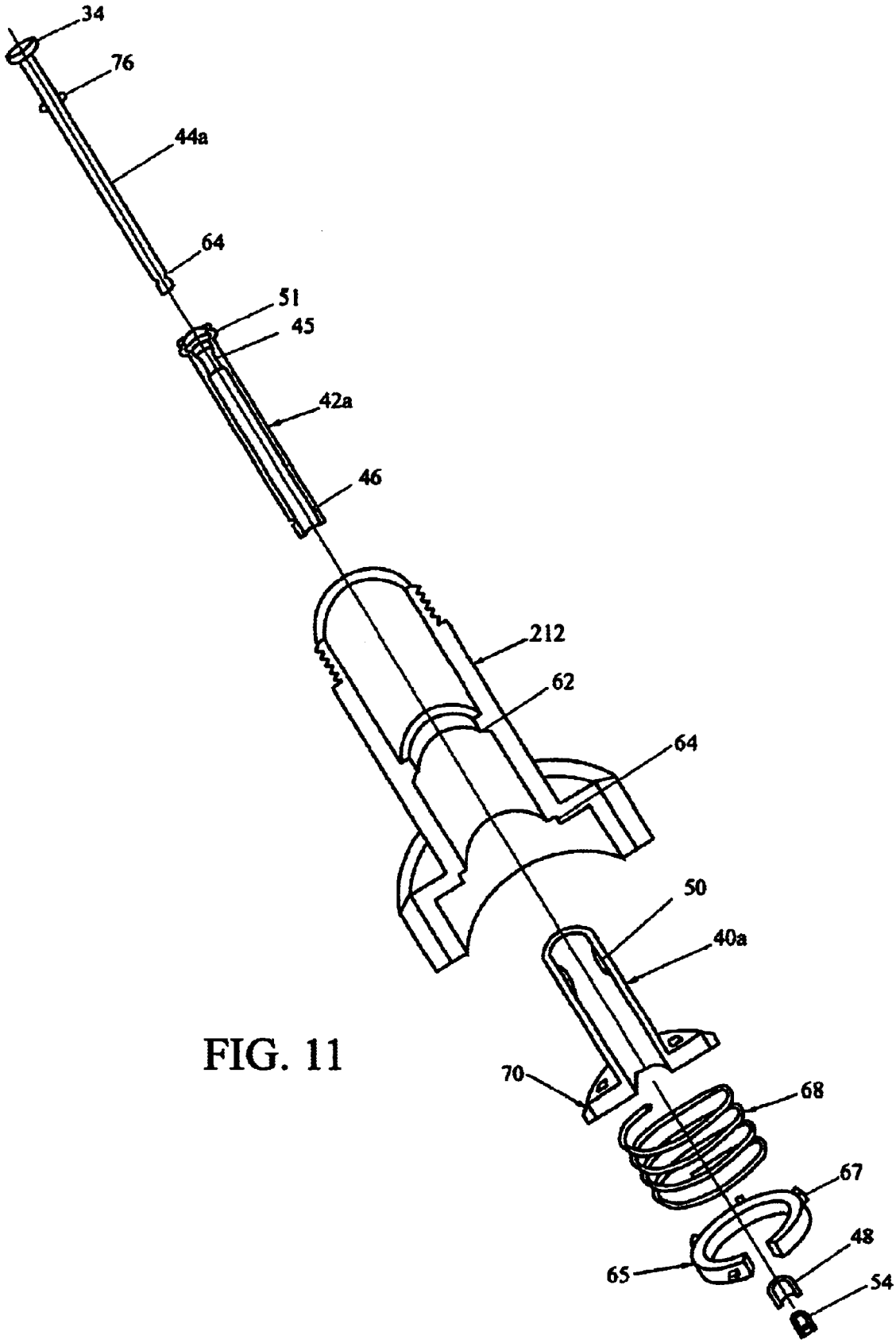
FIG. 11 is an exploded sectional view of the signaling and retrieval device of the alternative embodiment of the present invention.

With reference to FIG. 11, modified TAR 218 is generally similar to the three stage telescoping device in accordance with the first embodiment, but modified as follows: Prongs 32 are replaced at the base of modified first stage **40*a* by shut-off valve 70. Shut-off valve 70 comprises an annular element which engages the base of modified first stage 40*a*. The outside diameter of valve 70 is approximately equal to the inside diameter of modified riser 212, and the outer edge of valve 70 rides along the inner walls of modified riser 212. Valve 70** is perforated to allow the passage of water when the valve is open.

A further modification includes the addition of load relief ridge 76 (visible in FIG. 10) to modified third stage **44*a*. Load relief ridge 76** comprises an annular extension of the respective third and second stages, and facilitates load transfer from the shut-off valve spring to the nozzle without passing the force through the pistons.

Figure 7:
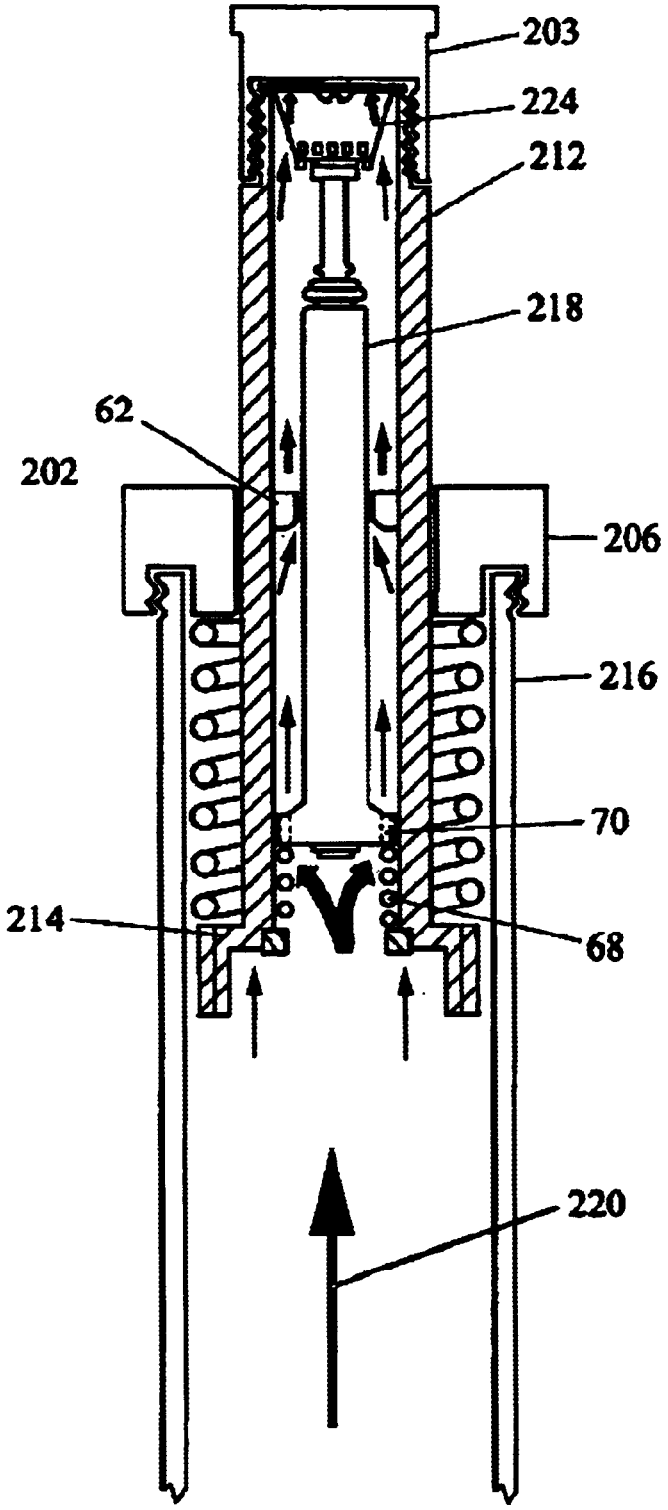
FIG. 7 is a schematic side view of the alternative embodiment of the sprinkler head of the present invention in an undamaged condition during a normal irrigation cycle.

FIG. 7 shows the alternative embodiment of the sprinkler head of the present invention during a normal irrigation cycle. Pressurized water 220 enters sprinkler head 202, and flows into the channel of modified riser 212. The pressurized water flows through the perforations in shut-off valve 70, past modified TAR 218, around valve seat 62, through optional grit filter 224, and strikes the underside of nozzle 208. The water pressure overcomes the downward force of spring 216 on modified riser 212, and thrusts nozzle 208 and modified riser 212 upwardly out of sprinkler head 202 through the aperture in cap 206. Ridge 214 secures the lower end of modified riser 212 within sprinkler head 202 and prevents the riser from being ejected in response to the surge of water pressure. Under normal operating conditions, water is thereby emitted from the nozzle and the lawn is irrigated.

Figure 8:
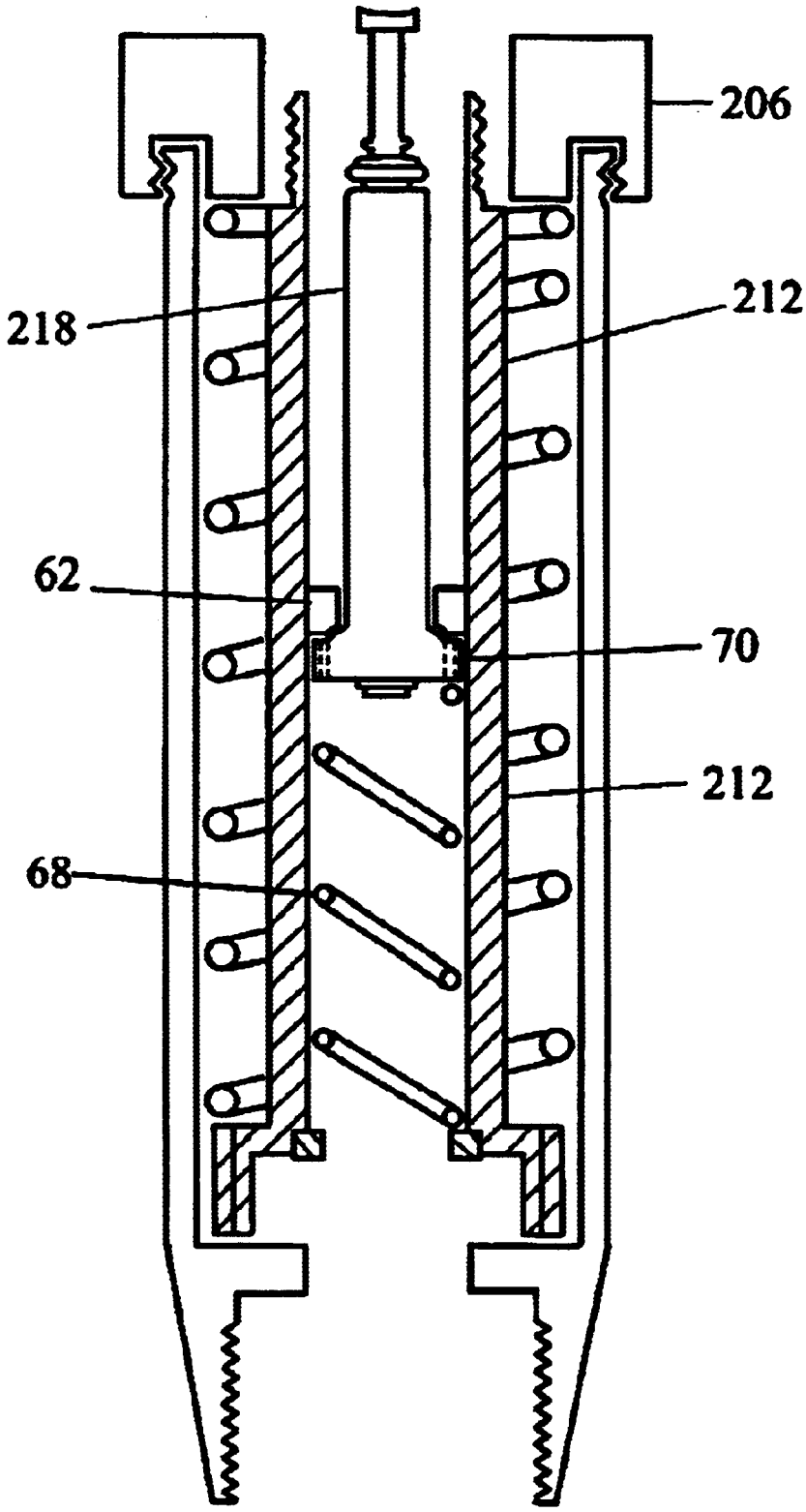
FIG. 8 is a schematic side view of the alternative embodiment of the sprinkler head of the present invention in which the nozzle is missing, and the shut-off valve is actuated.

FIG. 8 illustrates the sprinkler head of the present invention in which nozzle 208 has been dislodged from modified riser 212, not during an irrigation cycle. Absent the downward force from nozzle 208, modified TAR 218 is forced upward by valve spring 68, and shut-off valve 70 lodges against valve seat 62, effectively shutting-off the flow of water during the next irrigation cycle. However, the telescoping stages of modified TAR 218 remain retracted inside the sprinkler head body.

Figure 9:
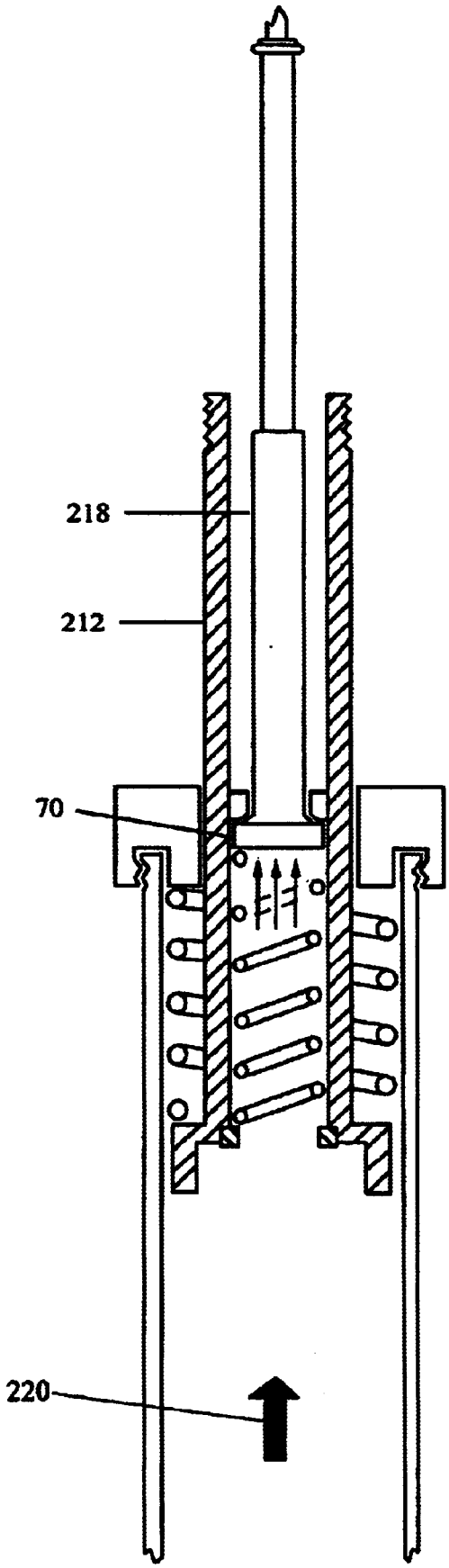
FIG. 9 is a schematic side view of the alternative embodiment of the sprinkler head of the present invention during a normal irrigation cycle in which the nozzle is missing.
Figure 10:
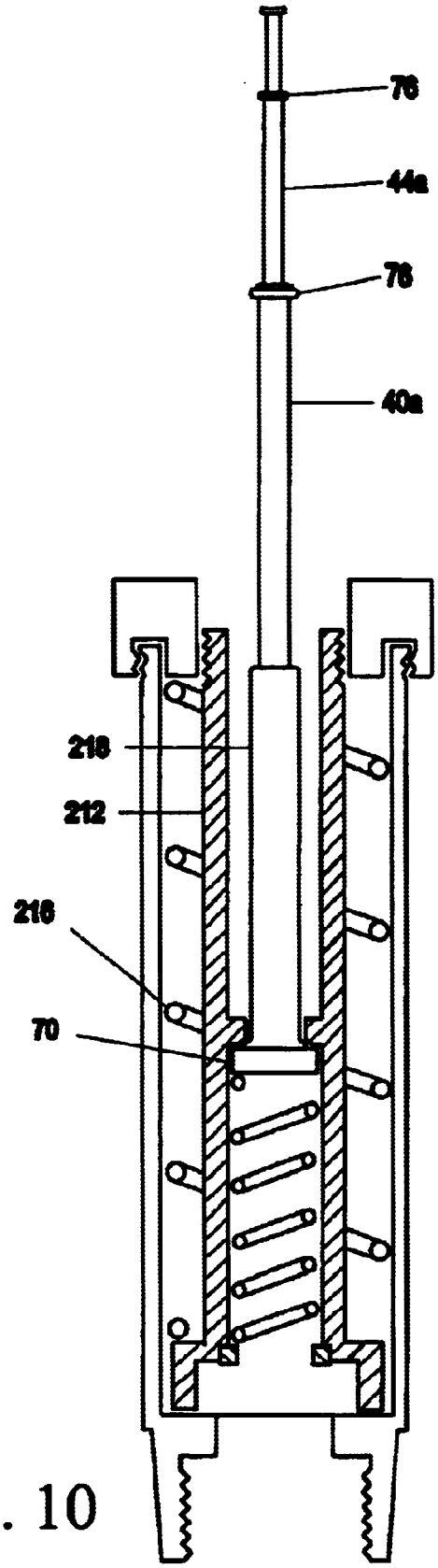
FIG. 10 is a schematic side view of the sprinkler head of the alternative embodiment of the present invention in which the nozzle is missing, showing the fully extended signaling and retrieval device after an irrigation cycle.

FIGS. 9 and 10 show the consequences of the next irrigation cycle. Water pressure 220 entering the damaged sprinkler head forces modified riser 212 upward out of the sprinkler head body. However, shut-off valve 70 contains the water in the sprinkler head. As shown in FIG. 9, water 220 entering the base of modified TAR 218 causes the extension of the telescoping stages of the modified TAR 218. As shown in FIG. 10, at the end of the irrigation cycle, modified riser 212 retracts back into the sprinkler head body under the force of riser return spring 216. However, the telescoping stages of the modified TAR 218 remain extended with second and third stages locked in place at their respective retention grooves. The modified TAR 218 is thus visible above the surface of the ground, thereby signaling the location of the damaged sprinkler head until discovered. Subsequent irrigation cycles do not cause the TAR 218 to retract, or shut off valve 70 to open.

Finally, in each embodiment, the TAR device facilitates the repair of the damaged sprinkler head. Pulling upwardly on the extended TAR overcomes the force exerted by the riser return spring, and lifts the riser from the sprinkler head body exposing the threads at the top of the riser. This enables a new nozzle to be threaded onto the riser without having to dig up the sprinkler head. The repair is executed by retracting the extended telescoping stages of the TAR back into the riser, screwing a replacement nozzle onto the existing riser, and allowing the riser to retract back into the sprinkler head body. The sprinkler head and alerting mechanism are now in working order for the next irrigation cycle.

Alternatively, if the riser has sustained damage, the cap is first removed from the sprinkler head. In the first embodiment, a new riser with nozzle can be replaced into the sprinkler head to restore it to operative condition, and the TAR 18 can be reinstalled in the sprinkler head. Likewise, the device as taught and practiced in the present invention permits retrofit installation of the signaling device in an existing pop-up style sprinkler head.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims:

What is claimed is:

1. A sprinkler head, comprising:

(a) a hollow housing adapted for connection to an irrigation system;

(b) a cap threadably engaged at a top end of said housing and having a central channel;

(c) a hollow riser slidably contained within said housing;

(d) a nozzle adapted for connection to one end of said riser for emitting irrigation water;

(e) a compression spring riding on said riser and engaging said housing for maintaining said riser in a normally retracted position; and (f) a signaling mechanism enclosed within said riser, said signaling mechanism including a plurality of telescoping sleeves adapted for upward telescoping extension;

whereby when said nozzle is partially or completely dislocated, water pressure causes said signaling mechanism to extend upward to indicate said damage or dislocation.

2. The sprinkler head of claim one, said signaling mechanism further having an open bottom end and a closed top end, said bottom end comprising a plurality of outwardly projecting prongs for securing said signaling device between said housing and said riser.

3. The signaling mechanism of claim one or two, said signaling device further comprising a plurality of alignment tabs extending from the outer wall of the lower-most sleeve for maintaining the central alignment of said signaling device within said riser.

4. The sprinkler head of claim one, said signaling device further comprising a plurality of telescoping sleeves adapted to lock in place when fully extended.

5. The sprinkler head of claim one, said signaling device further comprising a plurality of telescoping sleeves wherein the top-most of said sleeves is solid.

6. The sprinkler head of claim one, said signaling device further comprising a plurality of telescoping sleeves wherein the top-most of said sleeves is sealed at a bottom end.

7. The sprinkler head of claim one, said signaling device further comprising a plurality of telescoping sleeves wherein the top-most of said sleeves is capped at a top end.

8. The sprinkler head of claim one, said signaling mechanism further comprising a grit filter, said grit filter having a cylindrical basket-like body having a bottom surface attached to the top-most of said telescoping sleeves, cylindrical side walls connected to said bottom surface, and an open top, said bottom surface and said side wall having perforations for the passage of irrigation water therethrough.

9. A sprinkler head, comprising:

(a) a hollow housing adapted for connection to an irrigation system;

(b) a cap threadably engaged at a top end of said housing and having a central channel;

(c) a hollow riser slidably contained within said housing and further comprising an internal valve seat;

(d) a nozzle adapted for connection to one end of said riser for emitting irrigation water;

(e) a compression spring riding on said riser and engaging said housing for maintaining said riser in a normally retracted position;

(f) a signaling mechanism enclosed within said riser, said signaling mechanism having a plurality of telescoping sleeves adapted for upward telescoping extension, and further having an open bottom end and a closed top end, said bottom end comprising a shut-off valve;

(g) a coil spring upstream of said shut-off valve adapted to bias a valve against a valve seat;

whereby when said nozzle is partially or completely dislodged, said coil spring biases said shutoff valve against said valve seat to prevent a flow of water, and water pressure causes said signaling mechanism to extend upward to indicate said damage or dislocation.

10. The signaling mechanism of claim nine, said signaling device further comprising a plurality of alignment tabs extending from the outer wall of the lower-most sleeve for maintaining the central alignment of said signaling device within said riser.

11. The sprinkler head of claim nine, said signaling device further comprising a plurality of telescoping sleeves adapted to lock in place when fully extended.

12. The sprinkler head of claim nine, said signaling device further comprising a plurality of telescoping sleeves wherein the top-most of said sleeves is solid.

13. The sprinkler head of claim nine, said signaling device further comprising a plurality of telescoping sleeves wherein the top-most of said sleeves is sealed at a bottom end.

14. The sprinkler head of claim nine, said signaling device further comprising a plurality of telescoping sleeves wherein the top-most of said sleeves is capped at a top end.

15. The sprinkler head of claim nine, said signaling mechanism further comprising a grit filter, said grit filter having a cylindrical basket-like body having a bottom surface attached to the top-most of said telescoping sleeves, cylindrical side walls connected to said bottom surface, and an open top, said bottom surface and said side wall having perforations for the passage of irrigation water therethrough.

16. A method for repairing a damaged sprinkler head having the signaling mechanism of claim one or claim nine, comprising the steps of:

(a) locating said damaged sprinkler head by spotting said signaling mechanism extending from said damaged sprinkler head;

(b) pulling upwardly on said signaling mechanism to retrieve said riser from said housing;

(c) pushing said extended signaling mechanism back into said riser, and repositioning said grit filter;

(d) replacing said nozzle on the end of said riser;

(e) releasing said riser so that it fully retracts into said housing;

(f) seating said nozzle within said central channel of said cap;

whereby an in-situ repair can be made whenever said nozzle is partially or completely dislodged from said sprinkler head.

17. A method for repairing a damaged sprinkler head having the signaling mechanism of claim one or claim nine, comprising the steps of:

(a) locating said damaged sprinkler head by spotting said signaling mechanism extending from said damaged sprinkler head;

(b) pulling upwardly on said signaling mechanism to retrieve said riser from said housing and observe if the riser is damaged;

(c) removing said cap from said sprinkler head;

(d) removing said damaged riser and said signaling mechanism from said housing;

(e) installing a replacement riser, nozzle and signaling mechanism in said housing;

(f) re-attaching said cap to said sprinkler head;

whereby an in-situ repair can be made whenever said riser is damaged in said sprinkler head.

18. A method for repairing a damaged sprinkler head having the signaling mechanism of claim one, comprising the steps of:

(a) locating said damaged sprinkler head by spotting said signaling mechanism extending from said damaged sprinkler head;

(b) pulling upwardly on said signaling mechanism to retrieve said riser from said housing and observe if the riser is damaged;

(c) removing said cap from said sprinkler head;

(d) removing said damaged riser from said housing;

(e) installing a replacement riser and nozzle in said housing;

(f) re-attaching said cap to said sprinkler head;

whereby an in-situ repair can be made whenever said riser is damaged in said sprinkler head.

* * * * *